US009051749B2

(12) United States Patent
Peltier et al.

(10) Patent No.: US 9,051,749 B2
(45) Date of Patent: Jun. 9, 2015

(54) HYBRID METHOD OF ERECTING A COLD BOX USING PREFABRICATED AND FIELD ERECTED COMPONENTS

(75) Inventors: Stephane Peltier, Sugar Land, TX (US); Yves Hardy, Lachenaie (CA); Denis Cote, Sugar Land, TX (US); Gilles Poulin, Montreal (CA)

(73) Assignees: Air Liquide Global E&C Solutions US, Inc., Houston, TX (US); Air Liquide Canada, Inc., Montreal (CA)

( * ) Notice: Subject to any disclaimer, the term of this patent is extended or adjusted under 35 U.S.C. 154(b) by 1600 days.

(21) Appl. No.: 12/331,621

(22) Filed: Dec. 10, 2008

(65) Prior Publication Data

US 2010/0139208 A1 Jun. 10, 2010

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04H 5/10*** | (2006.01) |
| ***F25J 3/04*** | (2006.01) |

(52) U.S. Cl.

CPC ..... *E04H 5/10* (2013.01); *F25J 3/0489* (2013.01); *F25J 3/04945* (2013.01); *F25J 2290/42* (2013.01)

(58) Field of Classification Search

CPC ... F25J 3/0489; F25J 3/04945; F25J 2290/42; E04H 5/10

USPC ..... 52/414, 745.13; 220/560.4, 560.12, 220/560.13, 560.14, 560.15; 62/643

See application file for complete search history.

(56) References Cited

U.S. PATENT DOCUMENTS

| | | | | |
|---|---|---|---|---|
| 2,049,278 | A * | 7/1936 | Toussaint et al. | 52/281 |
| 2,323,297 | A * | 7/1943 | Collins | 220/565 |
| 2,955,686 | A * | 10/1960 | Blomeley et al. | 52/246 |
| 2,983,340 | A * | 5/1961 | Zittle | 52/245 |
| 4,041,722 | A * | 8/1977 | Terlesky et al. | 62/45.1 |
| 6,378,331 | B1 | 4/2002 | Vancauwenberghe et al. | |
| 7,088,109 | B2 | 8/2006 | Tanbakuchi | |
| 2005/0120723 | A1* | 6/2005 | Baudat | 62/50.2 |
| 2006/0162379 | A1* | 7/2006 | Wilhelm | 62/641 |
| 2008/0127675 | A1* | 6/2008 | Cote et al. | 62/643 |
| 2008/0302804 | A1* | 12/2008 | Simmons et al. | 220/560.05 |
| 2010/0162756 | A1* | 7/2010 | Clodic et al. | 62/643 |

FOREIGN PATENT DOCUMENTS

| | | |
|---|---|---|
| DE | 10342788 | 4/2005 |
| DE | 102005022090 | 2/2006 |

(Continued)

OTHER PUBLICATIONS

PCT Search Report and Written Opinion for PCT/IB2009/055424.

*Primary Examiner* — Joshua J Michener
*Assistant Examiner* — Theodore Adamos
(74) *Attorney, Agent, or Firm* — Justin K. Murray; Elwood L. Haynes

(57) ABSTRACT

A method of erecting a cold box that includes the steps of anchoring at least one column to a foundation in a substantially vertical orientation; anchoring a pipe rack module to the foundation in a substantially vertical orientation, wherein the pipe rack module is in close proximity to the at least one column; attaching interconnecting piping between the pipe rack module and the at least one column; anchoring at least four corner beams to the edge of the foundation in a substantially vertical orientation; attaching prefabricated panels with bracing to the corner beams, to form an enclosure around the column and piping; and attaching a roof to the enclose is provided.

5 Claims, 2 Drawing Sheets

(56) References Cited

FOREIGN PATENT DOCUMENTS

| | | |
|---|---|---|
| DE | 102006036612 | 2/2008 |
| EP | 1520079 | 4/2005 |
| FR | 2771160 | 5/1999 |
| GB | 860918 | 2/1961 |
| WO | 2004005651 | 1/2004 |
| WO | 2008014899 | 2/2008 |

* cited by examiner

Fig. 5
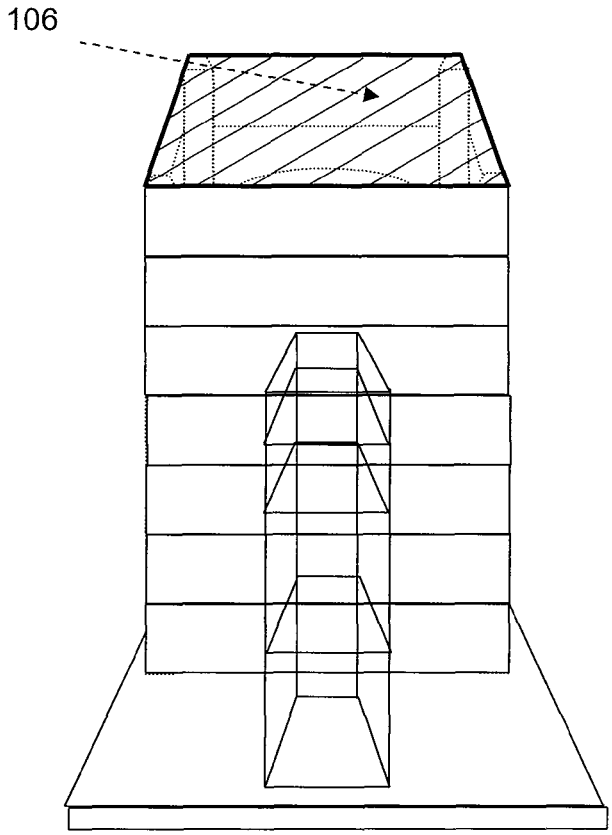
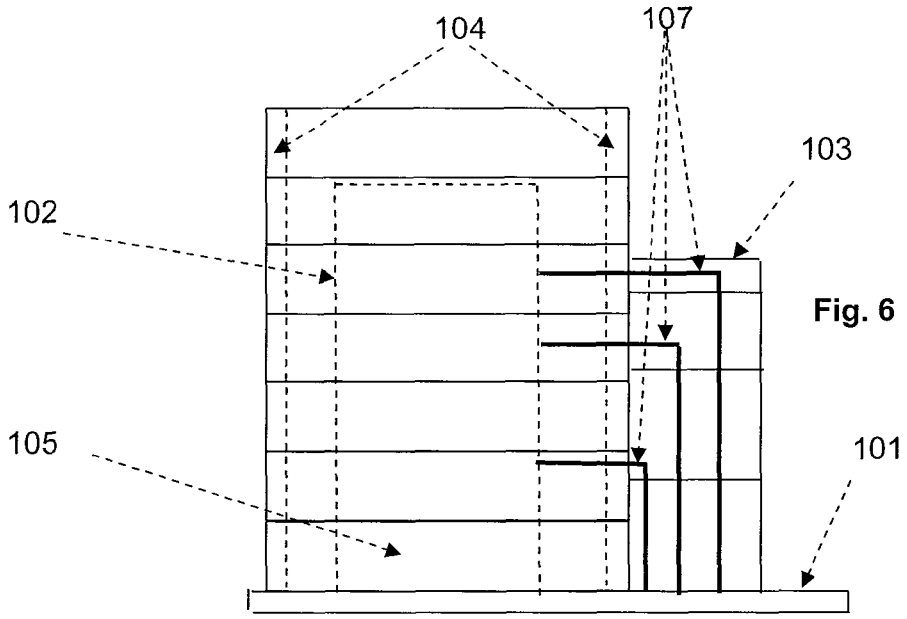
Fig. 6

HYBRID METHOD OF ERECTING A COLD BOX USING PREFABRICATED AND FIELD ERECTED COMPONENTS

FIELD OF THE INVENTION

This invention relates to a hybrid erection method for fabricating a cold boxy, involving using components that are prefabricated in a shop, and components that are field erected.

BACKGROUND

Conventionally, cryogenic units for the separation of gases comprise at least one distillation column which is disposed within an insulating structure called a cold box. The cold box typically has a substantially parallelepipedal shape so as to provide a predetermined thickness of insulation around the column. It is typical for the cryogenic distillation columns and all of the associated equipment (heat exchangers, cryogenic pumps, cryogenic valves, connecting pipes, etc.) operating at low temperature to be arranged within the cold box and then for the cold box to be filled with an insulator in loose bulk form, such as expanded perlite or compacted mineral wool. This insulator thermally protects each component from the external temperature and from that of other components which may be at different temperatures and heat leak that affects plant performance. This type of material derives its insulating properties from both low thermal conductivity (<0.05 W/m° C.) and a high head loss which is favourable in terms of the convection phenomenon.

Typically, in an effort to limit construction costs, and to maximize quality, the column is preassembled with tubing elements to as great of an extent as possible in the controlled environment of the shop. This preassembly usually consists of a framework corresponding to that of the future cold box, and of a cross section integrating the future insulation thicknesses all about the column. This is often completed prior to transporting and installing the assembly at the worksite. This is typically referred to as a "cold box package". Apart from their weight and their dimensions, sharply driving up the cost of transportation, such completely preassembled assemblies are confronted with serious transportation problems (e.g., difficulties clearing bridges, difficulties transporting the assemblies around corners . . . ) largely because of their great size. Also, equipment needed for lifting these packages is less available or extremely expensive. This is currently becoming a greater problem as the dimensions of the column are becoming greater, as dictated by the current need for massive production of gas.

An alternative would be to assemble and erect the column, cold box and the ancillary components entirely in the field. This will reduce the transportation issues, and possible reduce issues with misalignment and interconnection of fittings. However, utilizing this route allows the construction process to become vulnerable to variations in the weather, material delivery delays, issues involving labor shortages, and possible quality control problems.

Therefore, there exists a need in the industry for a solution that will allow the above problems to be circumvented.

SUMMARY

The present invention is a method of erecting a plant that includes the steps of anchoring at least one column to a foundation in a substantially vertical orientation; anchoring a pipe rack module to the foundation in a substantially vertical orientation, wherein the pipe rack module is in close proximity to the at least one column; attaching interconnecting piping between the pipe rack module and the at least one column; anchoring at least four corner beams to the edge of the foundation in a substantially vertical orientation; attaching prefabricated panels with bracing to the corner beams, to form an enclosure around the column and piping; and attaching a roof to the enclose.

In one embodiment of the present invention, the pipe rack module is prefabricated. In another embodiment of the present invention, the pipe rack module comprises one or more elements selected from the group consisting of control valves, manual valves, sample connections, piping, pre-cut panels with valve actuators, instrumentation, vapo flash, lighting, ladders and platforms, pre-wired junction box, instrument/electrical cable trays, piping support, duct to exchanger box, and the pump module.

In one alternative embodiment of the present invention, the at least one column comprises one or more elements selected from the group consisting of waste line, separator pots, large safety valve lines. In still another embodiment of the present invention, there is also a second pipe rack module. In yet another embodiment of the present invention, the second pipe rack module comprises one or more elements selected from the group consisting of waste line, separator pots, and large safety valve lines.

In still another embodiment of the present invention, the prefabricated panels are attached to the corner beams by bolting. In yet another embodiment of the present invention, the prefabricated panels are connected vertically or horizontally. In a still further embodiment of the present invention, the prefabricated panels are attached to the edge of the foundation or to adjacent prefabricated panels with bolts.

BRIEF DESCRIPTION OF DRAWINGS

The invention may be understood by reference to the following description taken in conjunction with the accompanying drawings, and in which:

FIG. 5 is a schematic representation of the step of attaching a roof to the enclosure in accordance with one embodiment of the present invention.

FIG. 6 is a schematic representation of an embodiment of the present invention.

DESCRIPTION OF PREFERRED EMBODIMENTS

The present invention has for its object to provide a method that permits maintaining the quality criteria of preassembly in the factory of elements requiring high quality control, greatly limiting the problems and the costs of transport to the utilization site and facilitating its installation on site in various types of cold boxes.

To accomplish this, according to one characteristic of the invention, the construction method comprises the steps of forming a preassembled pipe rack module. This pipe rack module may be preassembled in the shop where quality control may be more precisely monitored. The construction method may also include the preassembly of the column and it's ancillary components in the shop, provided that the column itself is not too large to be transported to the construction site. These preassembled components are relocated to the construction site, where they are interconnected. A field erected cold box is then constructed to surround and insulate the cryogenic components, thereby resulting in a hybrid, field erected and prefabricated assembly.

The method of the present invention allows for the erecting a cold box in the field utilizing prefabricated and field erected components. The first step of the method comprises anchoring at least one column to a foundation in a substantially vertical orientation.

The second step comprises anchoring a pipe rack module to said foundation in a substantially vertical orientation, wherein said pipe rack module is in close proximity to said at least one column. In the third step interconnecting piping is attached between said pipe rack module and said at least one column . . . . The next step involves anchoring at least four corner beams to the edge of said foundation in a substantially vertical orientation. Next, the prefabricated panels are attached with bracing to said corner beams, to form an enclosure around said column and piping. Finally a roof is attached to the enclosure.

Figure 1:
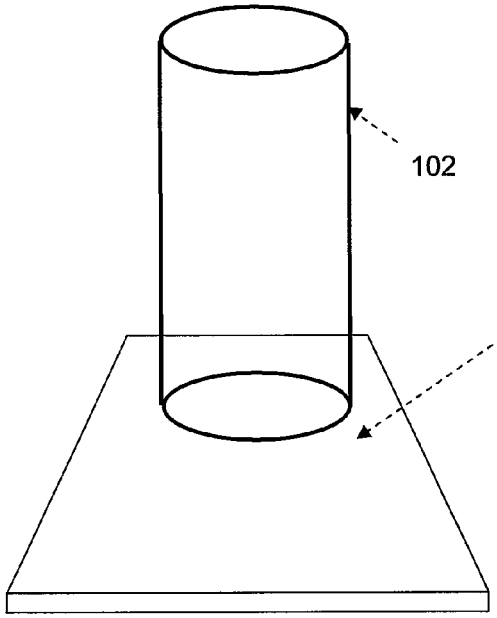
FIG. 1 is a schematic representation of the step of anchoring at least one column to a foundation in accordance with one embodiment of the present invention.

Turning to FIG. 1, a foundation 101 is created. Foundation 101 may be made of materials, and with techniques, well known in the art. Upon the foundation 101, a pre-assembled column 102 is delivered and installed in a substantially vertical orientation. The preassembled column 102 may be installed by techniques that are well known in the art. In this context, substantially vertical is understood to mean that preassembled column 102 is oriented in such a manner that the descending liquid-phase fluid within the column interacts with the rising vapour-phase fluid in the manner intended by the column designers. In one embodiment, substantially vertical is within 5 degrees of normal with respect to horizontal. In another embodiment, substantially vertical is within 2 degrees of normal with respect to horizontal. The column 102 may also include one or more additional components selected from a waste line, separator pots or large safety valves. The column 102 may comprise one distillation column or multiple distillation columns.

Figure 2:
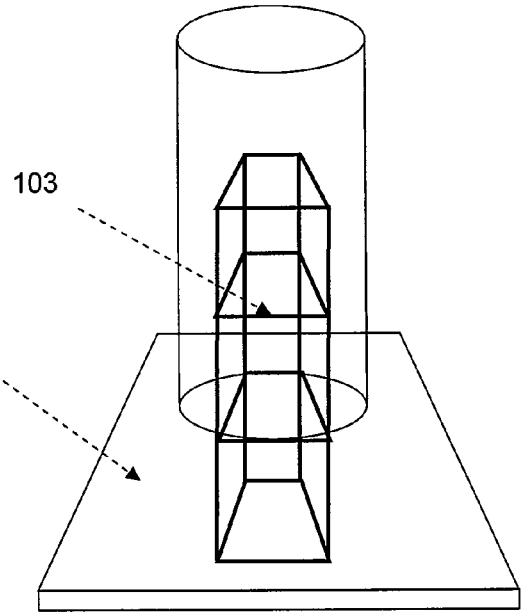
FIG. 2 is a schematic representation of the step of anchoring a pipe rack module to a foundation in accordance with one embodiment of the present invention.

Turning to FIG. 2, also on foundation 101, a pre-assembled pipe rack module 103 is delivered and installed in a substantially vertical orientation. Pre-assembled pipe rack module 103 may be fabricated in a facility in such a manner that conditions such as inclimate weather, limited visibility, labor shortages, etc do not affect the quality, schedule, or delivery of this component. The pipe rack module 103 is located, in close proximity to the column 102. In this context, close proximity is understood to mean as close as is practical, thereby limiting the length of the various interconnections, and minimizing the amount of field welding and assembly. In one embodiment, close proximity is less than 20 feet. In another embodiment, close proximity is less than 15 feet. The pipe rack module 103 may also include one or more additional components selected from control valves, manual valves, sample connections, interconnecting piping, pre-cut panels with valve actuators, instrumentation, vapo flash, lighting, ladders and platforms, pre-wired junction box, instrument/electrical cable trays, piping support, and duct to exchanger box. Once the pipe rack module 103 is in place, the multiple interconnections with column 102 are fabricated in the field.

Figure 3:
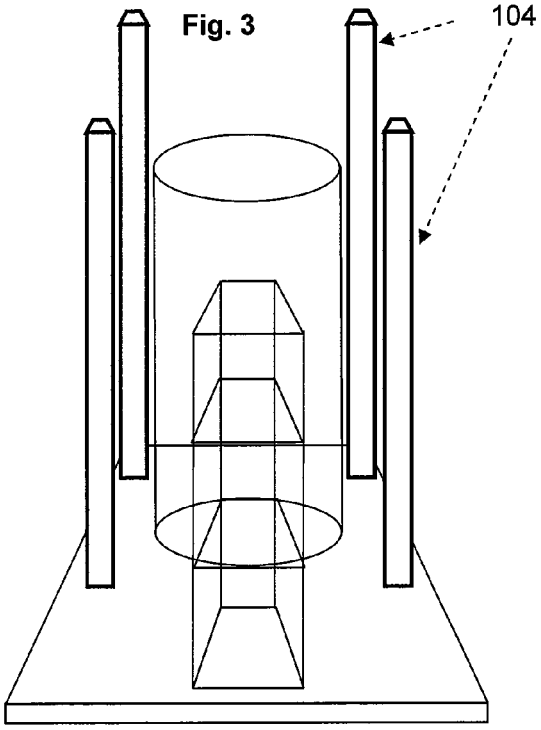
FIG. 3 is a schematic representation of the step of anchoring at least four corner beams to a foundation in accordance with one embodiment of the present invention.
Figure 4:
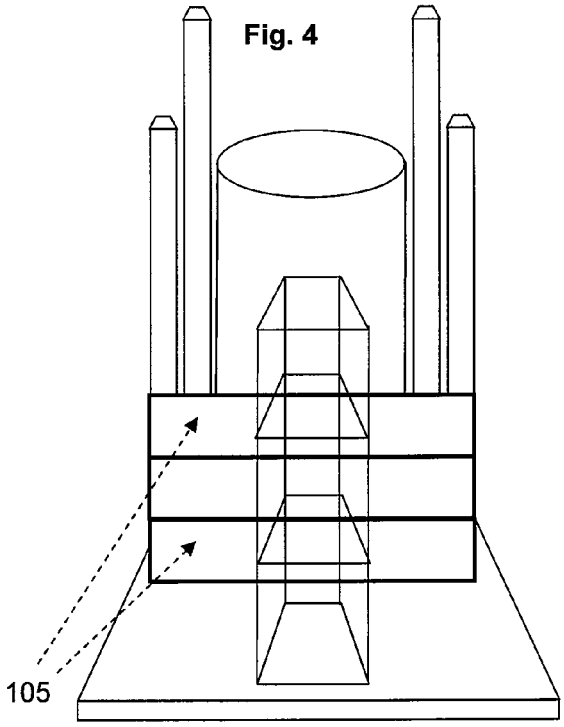
FIG. 4 is a schematic representation of the step of attaching prefabricated panels to the corner beams in accordance with one embodiment of the present invention.

Turning to FIG. 3, also on the foundation 101, beams 104 are installed in a substantially vertical orientation. Typically there will be four such beams 104 installed at the corners. Other possible layouts include any building design that accommodates the size and shape required of the pipe rack module 103 and column 102. In one embodiment, there are from four to eight beams 104. As indicated in FIG. 4, prefabricated panels 105 with bracing are then attached to corner beams 104 to form an enclosure around column 102. These prefabricated panels 105 may be sized to accommodate local, commercially available plate sizes. These prefabricated panels 105 may be sized to allow for stacking on flat bed trucks for ease of transportation. These prefabricated panels 105 may be attached to one another, and corner beams 104, by bolts, using gaskets or silicone for sealing. In other embodiments, any attaching means known in the art may be used. These prefabricated panels 104 may be custom made to accommodate manholes, required piping cut-outs, duct connections or Perlite dump connections. As indicated in FIG. 5, a roof segment 106 is then added to fully enclose the column 102. At this time, an insulating material such as perlite may be added to the volume between the enclosure of the panels 105, roof segment 106 and column 102.

One skilled in the art would recognize that it is possible to create a single, monolithic foundation.

Illustrative embodiments have been described above. While the method in the present application is susceptible to various modifications and alternative forms, specific embodiments thereof have been shown by way of example in the drawings, and have been herein described in detail. It should be understood, however, that the description herein of specific embodiments is not intended to limit the method in the present application to the particular forms disclosed, but on the contrary, the method in the present application is to cover all modifications, equivalents, and alternatives falling within the spirit and scope of the method in the present application, as defined by the appended claims.

It will, of course, be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but, would nevertheless, be a routine undertaking for those of ordinary skill in the art, having the benefit of this disclosure.

What is claimed is:

1. A hybrid method of erecting a cold box in the field utilizing prefabricated and field erected components, said method comprising the following steps:

a. anchoring at least one prefabricated distillation column to a foundation in a substantially vertical orientation;

b. anchoring a pipe rack module to said foundation in a substantially vertical orientation, wherein said pipe rack module is in close proximity to said at least one distillation column;

c. attaching interconnecting piping between said pipe rack module and said at least one distillation column;

d. anchoring at least four corner beams to an edge of said foundation in a substantially vertical orientation;

e. attaching prefabricated panels with bracing to said corner beams, to form an enclosure around said distillation column and piping; and f. attaching a roof to said enclosure.

2. The method of claim 1, wherein said pipe rack module is prefabricated.

3. The method of claim 1, wherein said prefabricated panels are attached to said corner beams by bolting.

4. The method of claim 1, wherein said prefabricated panels are connected vertically or horizontally.

5. The method of claim 4, wherein said prefabricated panels are attached to the edge of said foundation or to adjacent prefabricated panels with bolts.

* * * * *